US008950378B2

(12) United States Patent
Holt et al.

(10) Patent No.: US 8,950,378 B2
(45) Date of Patent: Feb. 10, 2015

(54) RETARDING SYSTEM

(75) Inventors: Bradford Jay Holt, Montgomery, IL (US); Thomas Lynn Grill, Marseilles, IL (US); Steven Kohl Anderson, Montgomery, IL (US)

(73) Assignee: Caterpiller Inc., Peoria, IL (US)

( * ) Notice: Subject to any disclaimer, the term of this patent is extended or adjusted under 35 U.S.C. 154(b) by 179 days.

(21) Appl. No.: 13/469,678

(22) Filed: May 11, 2012

(65) Prior Publication Data

US 2013/0298867 A1 Nov. 14, 2013

(51) Int. Cl.
*F01L 13/06* (2006.01)

(52) U.S. Cl.
USPC ..... 123/320; 123/321; 123/323

(58) Field of Classification Search
CPC ..... F02D 13/04; F01L 13/06; F01L 13/065
USPC ..... 123/320, 321, 323
See application file for complete search history.

(56) References Cited

U.S. PATENT DOCUMENTS

| | | | | |
|---|---|---|---|---|
| 6,463,377 | B2 * | 10/2002 | Minowa et al. | 701/70 |
| 6,536,408 | B1 | 3/2003 | Warner | |
| 6,594,996 | B2 * | 7/2003 | Yang | 60/602 |
| 2009/0187331 | A1 * | 7/2009 | Olsson | 701/112 |
| 2010/0137102 | A1 * | 6/2010 | Sopko et al. | 477/118 |
| 2011/0125376 | A1 | 5/2011 | Chappell et al. | |
| 2012/0059572 | A1 * | 3/2012 | Larsson et al. | 701/112 |
| 2012/0067331 | A1 * | 3/2012 | Pipis et al. | 123/564 |

OTHER PUBLICATIONS

Thomas Schmitz, The New Mercedes-Benz Engine Brake with Pulsed Decompression Valve—(DVB), Nov. 7, 1994, SAE International, 942266, p. 1-10.*

* cited by examiner

*Primary Examiner* — Stephen K Cronin
*Assistant Examiner* — Robert Werner
(74) *Attorney, Agent, or Firm* — Finnegan. Henderson, Farabow, Garrett & Dunner LLP

(57) ABSTRACT

A machine includes a power source, an engine retarder associated with the power source, and a traction device receiving power from the power source and configured to propel the machine. The machine also includes a brake mechanism associated with the traction device, and a controller in communication with the engine retarder and the brake mechanism. The controller is configured to activate the engine retarder, substantially simultaneously with the brake mechanism, based on a brake pressure associated with the brake mechanism.

17 Claims, 7 Drawing Sheets

RETARDING SYSTEM

TECHNICAL FIELD

The present disclosure relates generally to a retarding system and, more particularly, to a retarding system that is responsive to fluid pressure.

BACKGROUND

Machines, including on and off-highway haul and vocational trucks, wheel loaders, motor graders, and other types of heavy machinery generally include a multi-speed, bidirectional, automatic transmission drivingly coupled to an engine by way of a hydraulic torque converter. The hydraulic torque converter multiplies and/or absorbs torque fluctuations transmitted from the engine to the transmission by allowing slippage between an output shaft of the engine and an input shaft of the transmission. Such machines also include one or more braking mechanisms, such as service brakes associated with the wheels of the machine, to controllably decelerate the machine when braking is required.

Since the engine output and transmission input shafts are mechanically coupled, the engine can be used to assist the service brakes in slowing the machine's travel. For example, during an "engine braking" operation, power can be transferred from the wheels of the machine through the transmission to drive the engine. The natural resistance of the engine may dissipate some of the transferred power, thereby slowing the machine. Moreover, during an "exhaust braking" operation, power may be dissipated by, for example, increasing backpressure in an exhaust manifold of the engine. However, because such machines typically require the use of a separate pedal or other like operator interface device to activate and control such engine or exhaust braking, it can be difficult for machine operators to utilize engine or exhaust braking, in conjunction with the service brakes of the machine, in situations where such augmented machine braking is desired. Such situations may include, for example, emergency braking, and braking while traversing a relatively steep decline or other terrain where extended machine braking is necessary.

One method of improving the retarding capacity of a machine is described in U.S. Pat. No. 6,536,408 (the '408 patent) Warner. The '408 patent describes a braking system that includes a throttle pedal position sensor, a brake pedal position switch, and a mode selector configured to operate engine compression brakes at various levels. If a sensed brake pedal position exceeds a preset position threshold, a computer associated with the mode selector may engage the engine compression brakes. The level of engine compression braking may then be increased in response to, for example, further manipulation of the brake pedal.

Although the braking system of the '408 patent may assist in controlling the travel speed of a vehicle, it may be inadequate for some situations. In particular, because the compression brakes of the '408 patent are activated solely in response to brake pedal position, the responsiveness and controllability of the system described by the '408 patent may not be acceptable in, for example, emergency braking and/or extended braking operations. For example, in such operations the compression brakes of the '408 patent may remain inactive even if engine retarding is desired by the operator.

The disclosed retarding system is directed to overcoming one or more of the problems set forth above.

SUMMARY OF THE INVENTION

In an exemplary embodiment of the present disclosure, a machine includes a power source, an engine retarder associated with the power source, and a traction device receiving power from the power source and configured to propel the machine. The machine also includes a brake mechanism associated with the traction device, and a controller in communication with the engine retarder and the brake mechanism. The controller is configured to activate the engine retarder, substantially simultaneously with the brake mechanism, based on a brake pressure associated with the brake mechanism.

In an additional exemplary embodiment of the present disclosure, a method of braking a machine includes determining an operating characteristic of the machine, determining machine acceleration is not desired by an operator of the machine based on the operating characteristic, and activating an engine retarder of the machine, substantially simultaneously with a brake mechanism of the machine, based on a first brake pressure associated with the brake mechanism. The method also includes controlling operation of the engine retarder based on the first brake pressure.

In a further exemplary embodiment of the present disclosure, a method of braking a machine having a power source, a brake mechanism, and an engine retarder includes determining a brake pressure associated with the brake mechanism, the brake mechanism embodying a service brake operable to retard motion of the machine. The method also includes directing a signal indicative of the brake pressure to a controller of the machine in communication with the brake mechanism and the engine retarder, and activating the engine retarder with the controller, substantially simultaneously with the brake mechanism, in response to determining the brake pressure. The method also includes controlling operation of the engine retarder with the controller in a closed-loop manner. Operation of the engine retarder includes controlling a valve, operable to increase a natural resistance of the power source, based on the brake pressure.

DETAILED DESCRIPTION

Figure 1:
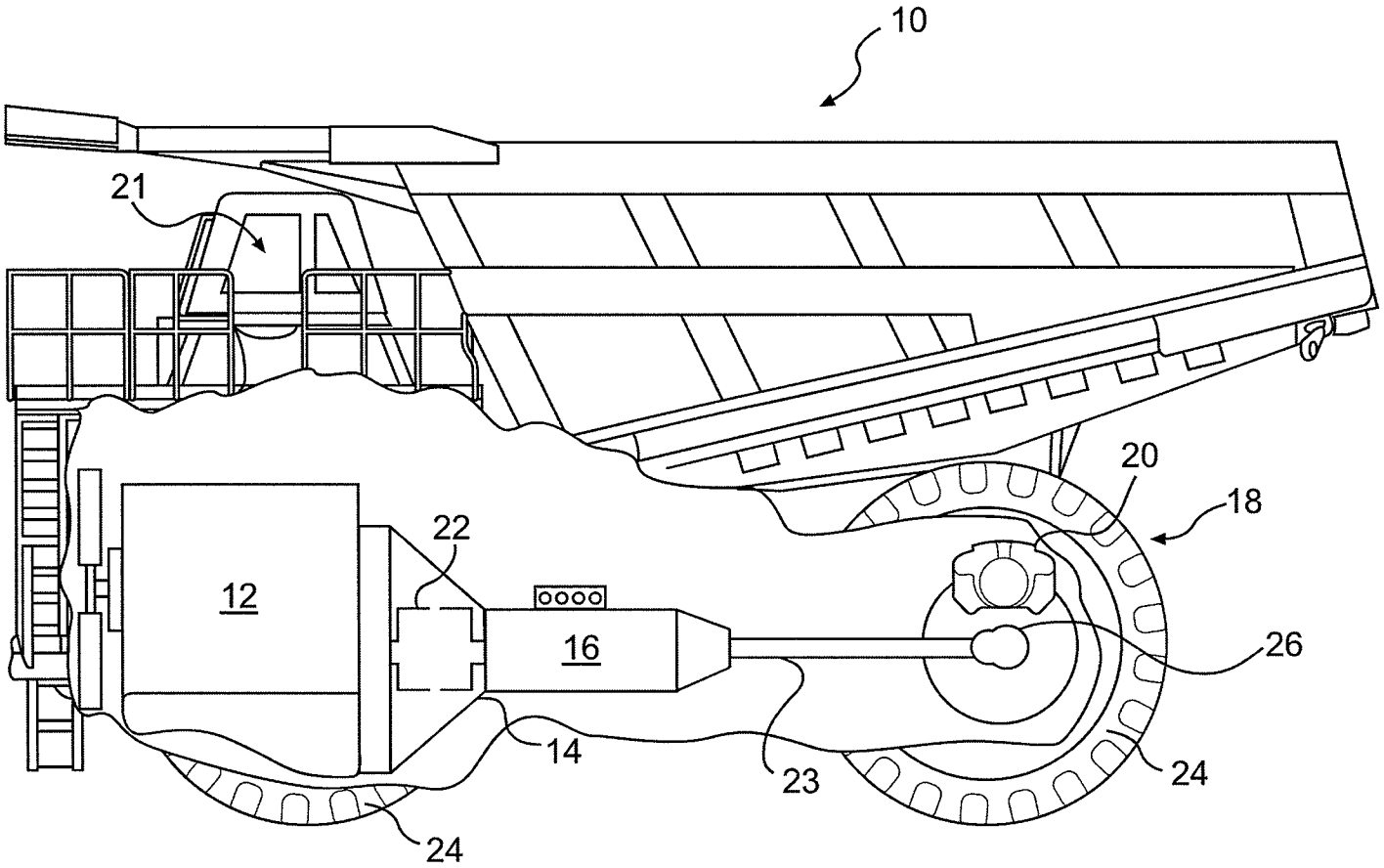
FIG. 1 is a diagrammatic illustration of an exemplary machine.

FIG. 1 illustrates an exemplary machine 10. The machine 10 may embody a mobile machine that performs some type of operation associated with an industry such as mining, construction, farming, transportation, or any other industry known in the art. For example, the machine 10 may be an earth moving machine such as an off-highway haul truck, a wheel loader, a motor grader, or any other suitable earth moving machine. The machine 10 may alternatively embody an on-highway vocational truck, a passenger vehicle, or any other operation-performing machine. The machine 10 may include, among other things, a power source 12, a torque converter 14, and a transmission 16. The machine 10 may also include a traction device 18 operably connected to the transmission 16, a brake mechanism 20 associated with the traction device 18, and an operator station 21.

The power source 12 may be configured to produce a power output and may include an internal combustion engine. For example, the power source 12 may include a diesel engine, a gasoline engine, a gaseous fuel-powered engine, or any other engine apparent to one skilled in the art. It is contemplated that the power source 12 may alternatively include a non-combustion source such as, for example, a battery, a fuel cell, a motor, or any other known non-combustion source of power.

The torque converter 14 may be a hydro-mechanical device configured to couple the power source 12 to the transmission 16. In particular, the torque converter 14 may conduct pressurized fluid between the output of the power source 12 and the input of transmission 16 to thereby drive the transmission 16, while still allowing the power source 12 to rotate somewhat independently of transmission 16. In addition, the torque converter 14 may include a lockup clutch 22 and/or other like mechanisms for directly mechanically coupling the output of power source 12 to the input of the transmission 16. In this arrangement, the torque converter 14 may selectively absorb and/or multiply the torque transferred between the power source 12 and the transmission 16 by either allowing or preventing slippage between the output rotation of the power source 12 and the input rotation of the transmission 16. It is further contemplated that the torque converter 14 may alternatively embody a non-hydraulic device such as, for example, a mechanical diaphragm clutch.

The transmission 16 may include numerous components that interact to transmit power from the power source 12 to the traction device 18. In particular, the transmission 16 may embody a multi-speed, bidirectional, mechanical transmission having a neutral gear ratio, a plurality of forward gear ratios, a reverse gear ratio, and one or more clutches (not shown). The clutches may be selectively actuated to engage predetermined combinations of gears (not shown) that produce a desired output gear ratio. The transmission 16 may be an automatic-type transmission, wherein shifting is based on a power source speed, a maximum selected gear ratio, and a shift map stored within a transmission controller. The output of the transmission 16 may be connected to rotatably drive the traction device 18 via a shaft 23, thereby propelling the machine 10.

The traction device 18 may include wheels 24 located on each side of machine 10 (only one side shown). Alternately, the traction device 18 may include tracks, belts, or other driven traction devices. The traction device 18 may be driven by the transmission 16 to rotate in accordance with an output rotation of the transmission 16.

The brake mechanism 20 may be configured to retard the motion of machine 10 and may be operably associated with a wheel 24 of the machine 10. In one embodiment, the brake mechanism 20 may be a hydraulic pressure-actuated wheel brake such as, for example a disk brake or a drum brake disposed intermediate a wheel 24 and a drive assembly 26. In such exemplary embodiments, the brake mechanism 20 may comprise a service brake of the machine 10. It is contemplated that the brake mechanism 20 may alternatively embody another non-hydraulic type of wheel brake such as an electric motor or any other similar mechanism known in the art.

Figure 2:
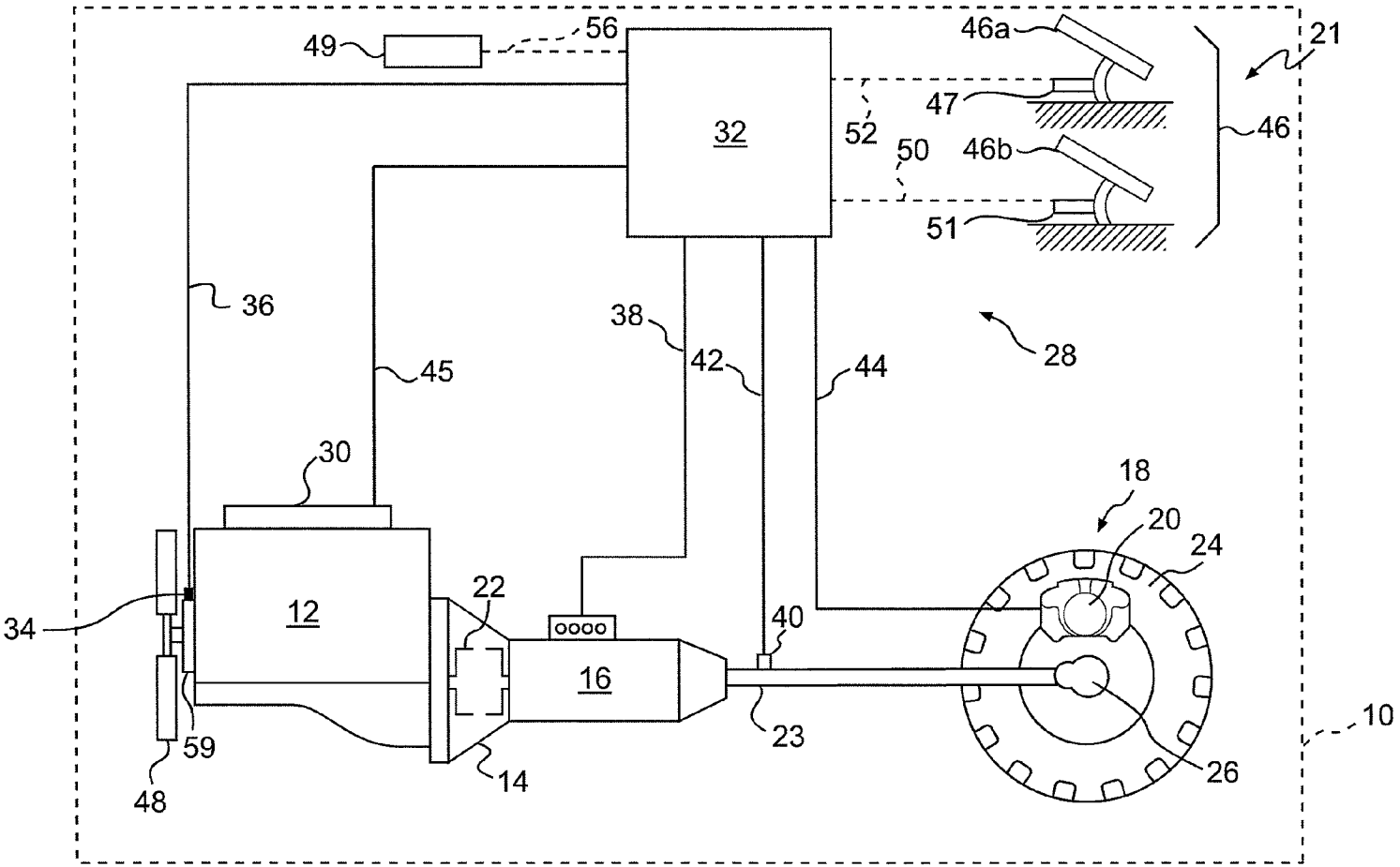
FIG. 2 is a diagrammatic illustration of an exemplary retarding system associated with the machine of FIG. 1.

The operator station 21 may be configured to receive input from a machine operator indicative of a desired acceleration and/or active retarding of the machine 10. Specifically, as illustrated in FIG. 2, the operator station 21 may include one or more operator interface devices 46 such as a throttle pedal **46*a* and a brake pedal 46*b* located forward of an operator seat. The operator interface devices 46 may embody proportional-type controllers configured to increase or decrease the acceleration of machine 10 by producing an acceleration signal that is indicative of a desired machine acceleration. It is contemplated that different operator interface devices may alternatively or additionally be included within operator station 21** such as, for example, single or multi-axis joysticks, wheels, knobs, push-pull devices, switches, levers, and other similar devices known in the art. Such additional operator interface devices may include, for example, a forward-neutral-reverse lever and/or other directional control devices.

The throttle pedal **46*a* may be manually actuated to increase the rotational speed of the power source 12 and the resulting travel speed of the machine 10. In particular, a degree of throttle pedal actuation may represent a desired acceleration and may proportionally control an amount of fuel supplied to the power source 12. It is contemplated that the throttle pedal 46*a*** may embody a mechanical device, an electrical device, a hydraulic device, or any other type of device known in the art.

A throttle sensor 47 may be provided for indicating whenever the throttle pedal **46*a* is actively indicating a desired acceleration of the machine 10, and the magnitude of the desired acceleration. The throttle sensor 47 may embody, for example, a switch or a pressure sensor capable of producing an electric signal indicating that positive acceleration is being requested. A switch may indicate a position or angle of throttle pedal 46*a*, while a pressure sensor may indicate a pressure of a pilot fluid pressurized by the motion of the throttle pedal 46*a*. For example, in embodiments in which the throttle sensor 47 comprises a pressure sensor, the throttle sensor 47 may produce electric signals indicative of fluid pressures associated with a throttle valve (not shown) and/or one or more fluid lines, pumps, and/or other hydraulic fluid components associated with the throttle pedal 46*a*. Such signals may be indicative of and/or responsive to manipulation of the throttle pedal 46*a* by the operator of the machine 10**.

The brake pedal **46*b* may be manually operated to direct pressurized fluid to the brake mechanism 20. A degree of brake pedal actuation may proportionally control a pressure and/or a flow rate of the fluid supplied to brake mechanism 20. It is contemplated that the brake mechanism 20** may alternatively be pneumatically actuated, mechanically actuated, electrically actuated, or actuated in any other manner known in the art.

A brake sensor 51 may be provided for indicating whenever active retarding (e.g. negative acceleration) of machine travel is desired and what magnitude of retarding is desired. The brake sensor 51 may embody, for example, a switch or a pressure sensor capable of producing an electric signal indicating that negative acceleration is requested. A switch may indicate a position or angle of brake pedal **46*b*, while a pressure sensor may indicate a pressure of a pilot fluid pressurized by brake pedal 46*b*. For example, in embodiments in which the brake sensor 51 comprises a pressure sensor, the brake sensor 51 may produce electric signals indicative of a fluid pressure associated with a brake valve (not shown), brake line, brake fluid pump, and/or other pneumatic or hydraulic fluid components associated with the brake pedal 46*b* and/or the brake mechanism 20. Such a fluid pressure may be referred to herein as "brake pressure." It is understood that the signals generated by the brake sensor 51 may be indicative of and/or responsive to manipulation of the brake pedal 46*b* by the operator of the machine 10**.

As illustrated in FIG. 2, the throttle pedal 46*a*, throttle sensor 47, brake pedal 46*b*, brake sensor 51, and brake mechanism 20 may comprise components of a retarding system 28 of the machine 10. The retarding system 28 may further include components that cooperate with brake mechanism 20, brake sensor 51, throttle sensor 47, power source 12, and/or transmission 16 to decelerate the machine 10. In particular, the retarding system 28 may further include, among other things, an engine retarder 30 and a controller 32.

The engine retarder 30 may embody any device that selectively increases the natural resistance of the power source 12 to motion. For example, the engine retarder 30 may embody an engine brake or an exhaust brake. An engine brake may be configured to selectively open and/or close one or more exhaust valves (not shown) fluidly connected to and/or otherwise associated with one or more combustion chambers of the power source 12 near the top dead center (TDC) position of a piston's compression stroke. As will be described in greater detail below, operation of the engine retarder 30 may be controlled, in a closed-loop manner, based on the brake pressure. By opening the exhaust valves near TDC of the compression stroke, highly-compressed air may be released to the atmosphere, thereby removing stored energy from the associated pistons of the power source 12. On the ensuing downward power stroke, essentially no energy is returned to the piston (and to the traction device 18), resulting in a deceleration of the machine 10.

In contrast, an exhaust brake may include a butterfly-type valve or other like flow control device fluidly connected to an exhaust manifold of the power source 12. For example, the exhaust brake may be configured to selectively open and/or close such a valve, and may be operable to increase pressure within the exhaust manifold in response to the brake pressure. For example, partially closing such a valve may assist in selectively restricting the exiting flow of exhaust gases. The restricted flow of exhaust gases may cause a backup of pressure within the power source 12. Such a backup of pressure may increase the work that the pistons of the power source 12 must perform during the compression and exhaust strokes of the power source 12, thereby resulting in a deceleration of the machine 10. In exemplary embodiments, the engine retarder 30 may be located downstream of the power source 12, such as between an output of the power source 12 and an input of the torque converter 14, or between an output of the torque converter 14 and an input of the transmission 16. In such exemplary embodiments, the engine retarder 30 may be configured to directly remove power from the power source 12 or from the transmission 16. The engine retarder 30 may be hydraulically operated, mechanically operated, electrically operated, pneumatically operated, or operated in any other suitable manner.

The controller 32 may embody a single microprocessor or multiple microprocessors that include a means for controlling an operation of the retarding system 28. Numerous commercially available microprocessors can be configured to perform the functions of the controller 32. It should be appreciated that the controller 32 could readily embody a general machine microprocessor capable of controlling numerous machine functions. Various other known circuits may be associated with the controller 32, including power supply circuitry, signal-conditioning circuitry, solenoid driver circuitry, communication circuitry, and other appropriate circuitry.

The controller 32 may be in communication with various components of the machine 10. In particular, the controller 32 may be in communication with a power source speed sensor 34 via a communication line 36 to receive an indication of a rotational speed of the power source 12, with the transmission 16 via a communication line 38 to affect downshifting of the transmission 16, with a machine travel speed sensor 40 via a communication line 42 to receive an indication of a travel speed of the machine 10, with the brake mechanism 20 via a communication line 44 to determine whether brake mechanism 20 is active or inactive, and with the engine retarder 30 via a communication line 45. The controller 32 may also be in communication with the throttle pedal 46*a*, the brake pedal 46*b*, and an inclinometer 49 via communication lines 52, 50, and 56, respectively. In exemplary embodiments, the controller 32 may be in communication with the throttle sensor 47 via the communication line 52 and with the brake sensor 51 via the communication line 50.

The power source and machine travel speed sensors 34, 40 may both embody magnetic pickup-type sensors. In particular, the power source speed sensor 34 may be associated with a flywheel 59 of the power source 12, and may be configured to sense a rotational speed and produce a corresponding speed signal. Similarly, the machine travel speed sensor 40 may be associated with the shaft 23, and configured to sense a travel speed and produce a corresponding speed signal.

The inclinometer 49 may embody a commonly known grade detection device. For example, the inclinometer 49 may be configured to monitor the grade on which the machine 10 is operating and/or is otherwise located, and to generate a signal indicative of the grade. In additional exemplary embodiments, the inclinometer 49 may be omitted, if desired.

As described above, the lockup clutch 22 may be engaged to retard the motion of the machine 10, and in exemplary embodiments, the lockup clutch 22 may be engaged in response to one or more inputs. For example, the controller 32 may receive one or more inputs associated with the throttle pedal 46*a*, brake pedal 46*b*, power source speed sensor 34, machine travel speed sensor 40, and/or inclinometer 49, and the controller 32 may engage the lockup clutch 22 in response to the input. Additionally or in the alternative, the controller 32 may engage the lockup clutch 22 in response to receiving, via one or more of the operator interface devices 46, a manual indication that lockup is desired. When the lockup clutch 22 is engaged, the wheels 24 may transmit power in a reverse direction through the transmission 16 and the lockup clutch 22 to the power source 12, where the natural resistance of the power source 12 may act to dissipate the power.

Figure 3:
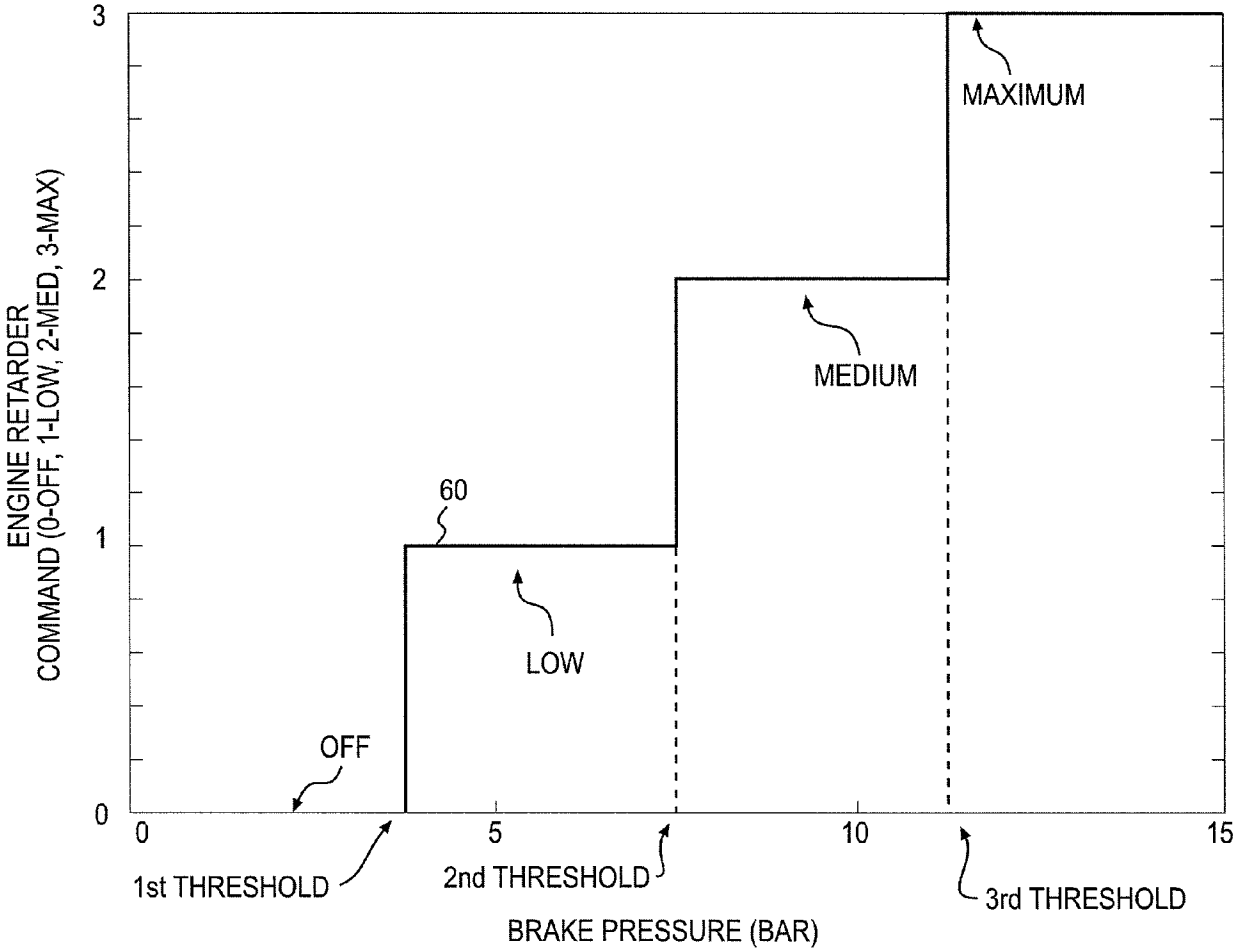
FIG. 3 shows a graph illustrating an exemplary relationship between brake pressure and various discrete engine retarder commands.
Figure 4:
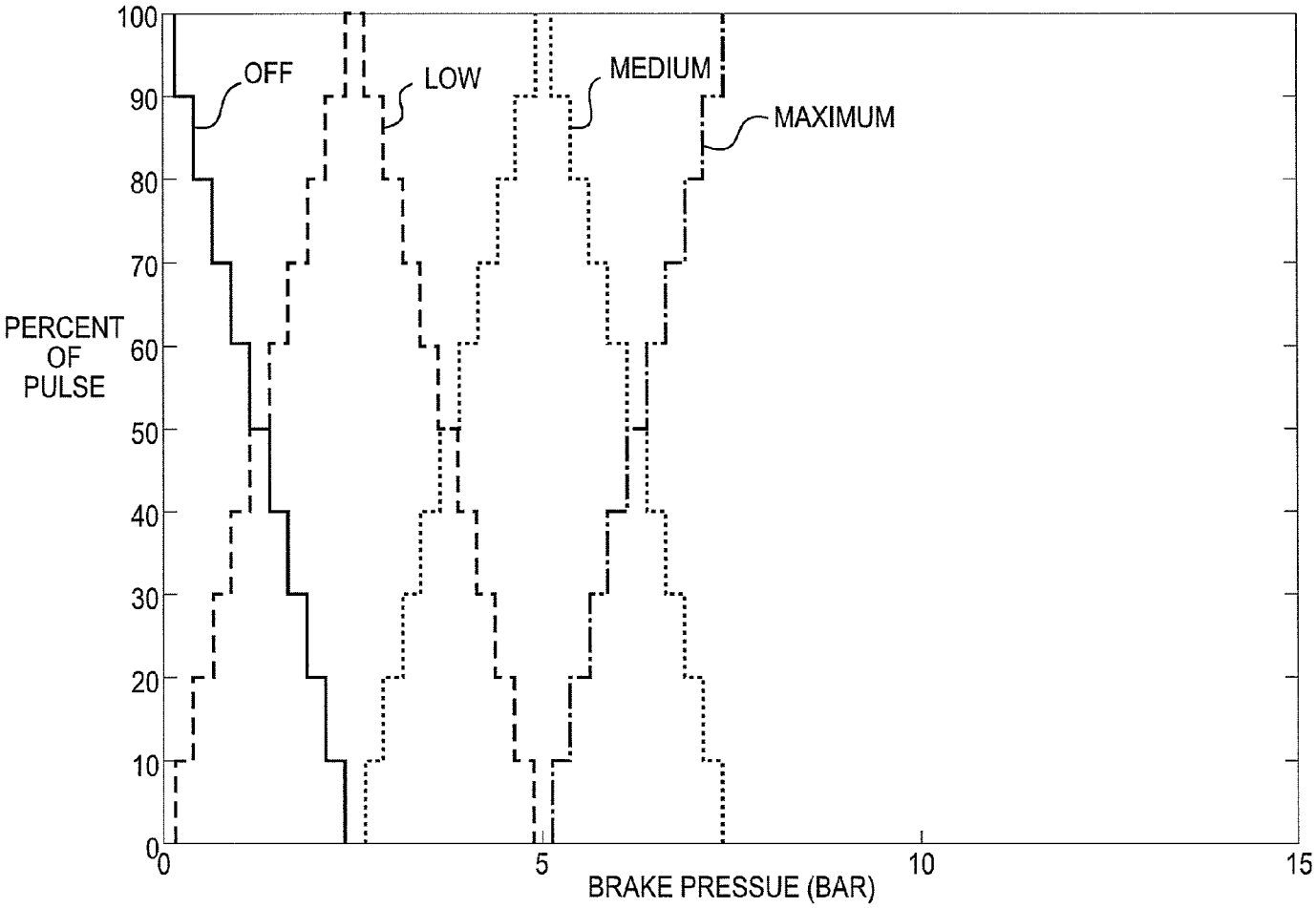
FIG. 4 shows a graph illustrating exemplary relationships between brake pressure and percent of pulse.
Figure 5:
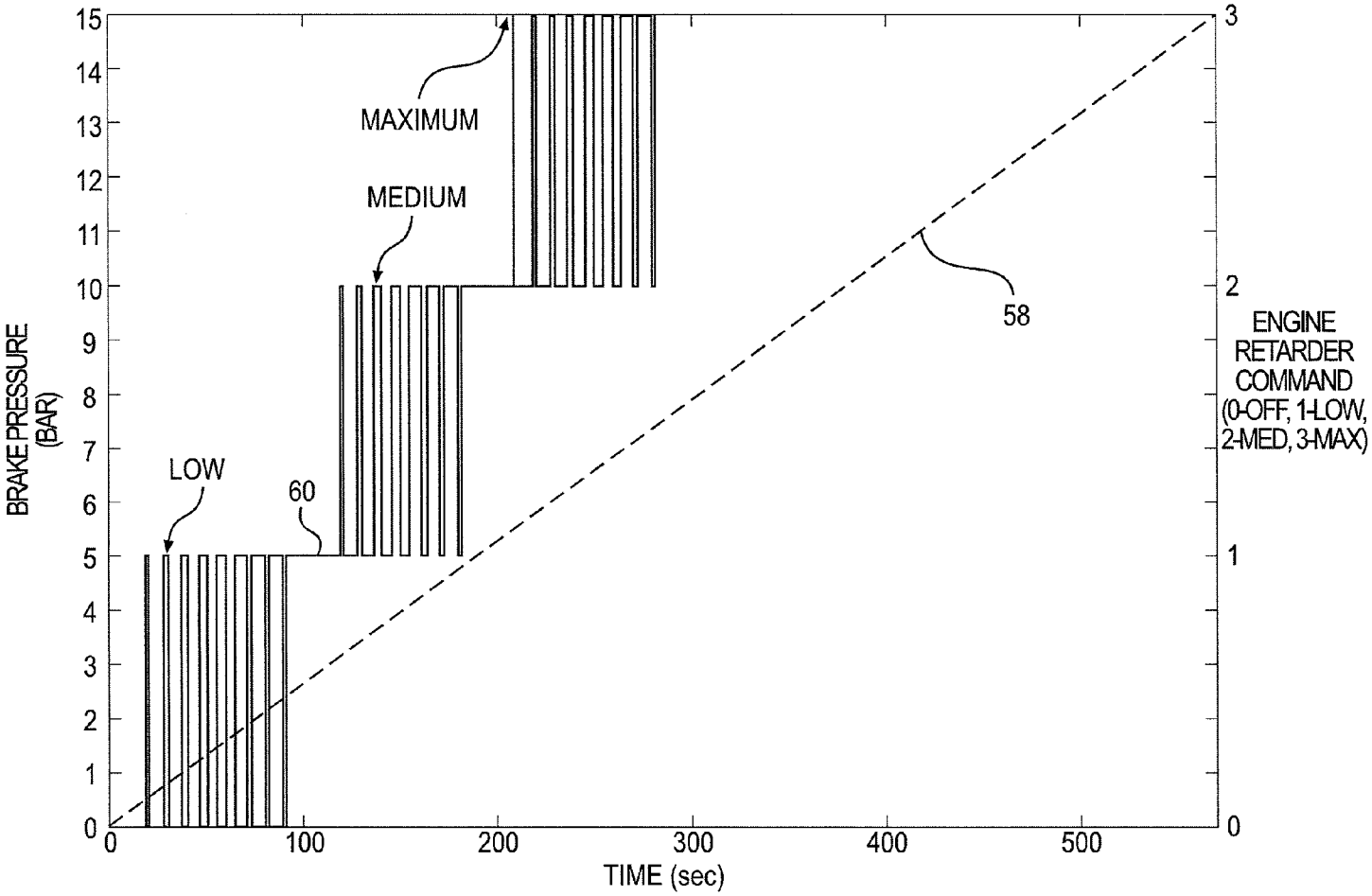
FIG. 5 shows a graph illustrating exemplary relationships between brake pressure and time.
Figure 6:
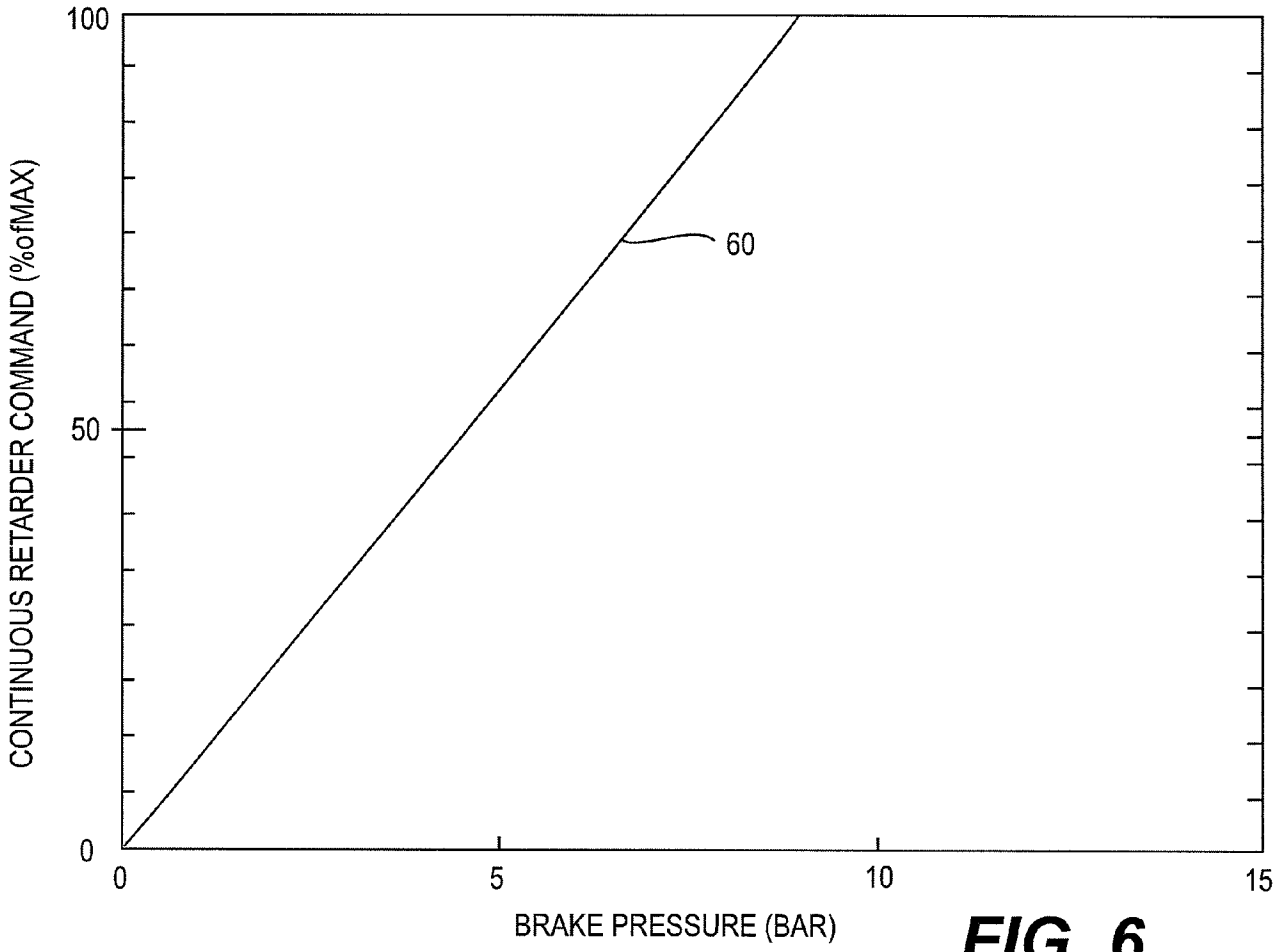
FIG. 6 illustrates an exemplary relationship between brake pressure and a substantially continuous engine retarder command.

The controller 32 may include one or more maps stored within an internal memory thereof, and the controller 32 may reference these maps to control operation of the retarding system 28. Each of these maps may include a collection of data in the form of tables, graphs, and/or equations. As shown in FIGS. 3 and 6, in exemplary embodiments, brake pressure may form an X axis of a two or three-dimensional graph for determining operation of the engine retarder 30 while engine retarder control commands may be shown on the Y axis of the same graph. In exemplary embodiments, discrete (0=off, 1=low, 2=medium, 3=maximum) or substantially continuous engine retarder commands may form a Y axis of the graph. As shown in FIG. 4, in further exemplary embodiments, a percentage of pulse (ranging from approximately 0% to approximately 100%) may be shown on the Y axis of the graph while brake pressure may be illustrated on the X axis. Additionally, as shown in FIG. 5, in still further exemplary embodiments, brake pressure may be shown on a left hand side Y axis, discrete engine retarder control commands may be shown on a right hand side Y axis, and time may be shown on the X axis. In exemplary embodiments of the present disclosure, the relationships illustrated in FIG. 4 may correspond to those shown in FIG. 5.

In one or more of the exemplary embodiments illustrated in FIGS. 3-6, a first control line 58 illustrating operation of the brake mechanism 20 and a second control line 60 illustrating operation of the engine retarder 30 may be shown on the same graph. The graphs illustrated in FIGS. 3-6 may be illustrative of various relationships between brake pressure, time, and/or percent of pulse, and the activation and/or operation of the engine retarder 30. As will be described in greater detail below, activation and/or operation of the engine retarder 30 may be controlled in response to and/or as a function of such brake pressure. It is also understood that the various brake pressure values, threshold values, time values, pulse percentages, and other aspects of the relationships illustrated in FIGS. 3-6 are merely exemplary, and that other values may be used and are within the scope of the present disclosure.

In exemplary embodiments, brake pressure may be increased substantially continuously during operation of the machine 10. Such an increase may be affected by, for example, the operator depressing the brake pedal 46*b* at a substantially continuous rate during a machine braking operation. While the first control line 58 shown in FIG. 5 is representative of such an exemplary substantially continuous increase in brake pressure, in further exemplary embodiments, the slope of the first control line 58 may be greater than (indicating a relatively faster increase in brake pressure) or less than (indicating a relatively slower increase in brake pressure) that shown in FIG. 5. In still further exemplary embodiments, the first control line 58 may be curved, stepped, and/or any other configuration, and such configurations may be indicative of increases or decreases in brake pressure that may or may not be substantially continuous. In such exemplary embodiments, the configuration and slope of the first control line 58 may be a function of, for example, operator manipulation of the brake pedal 46*b*, and operation of the brake mechanism 20 may correspond to and/or may otherwise be responsive to such manipulation.

Activation and/or operation of the engine retarder 30 may also correspond to and/or may otherwise be responsive to brake pressure, and thus, to manipulation of the brake pedal 46*b*. For example, as illustrated by the second control line 60 shown in FIG. 3, the engine retarder 30 may remain idle (i.e., "off") until a first brake pressure threshold has been reached. It is understood that a corresponding first control line 58 representative of an exemplary substantially continuous increase in brake pressure, has been omitted from FIG. 3 for clarity. As shown in FIG. 3, a first brake pressure threshold may be between approximately 3 bar and approximately 5 bar. Upon reaching this first brake pressure threshold, the controller 32 may output a first discrete command (shown as "1" on the Y axis of the graph in FIG. 3) to the engine retarder 30, controlling the engine retarder 30 to operate at a substantially constant "low" setting. At such a low setting, the engine retarder 30 may, for example, at least partially open one or more exhaust valves associated with one or more combustion chambers of the power source 12 near TDC of the compression stroke, thereby controllably venting highly-compressed air to the atmosphere at a first relatively low retarding level during each compression stroke. As described above, such combustion chamber exhaust valves may be fluidly connected to the respective combustion chambers. Alternatively, at such a low setting, the engine retarder 30 may operate a valve disposed within an exhaust manifold of the power source 12 to controllably restrict the exiting flow of exhaust gases. The restricted flow of exhaust gases may cause a backup of pressure within the power source 12 at a first relatively low retarding level.

As shown in FIG. 3, operation of the engine retarder 30 may continue at the substantially constant low setting until the brake pressure reaches a second brake pressure threshold. Such a second brake pressure threshold may be between approximately 6 bar and approximately 9 bar, and upon reaching this second brake pressure threshold, the controller 32 may output a second discrete command (shown as "2" on the Y axis of the graph in FIG. 3) to the engine retarder 30, controlling the engine retarder 30 to operate at a substantially constant "medium" setting. At such a medium setting, the engine retarder 30 may, for example, open the combustion chamber exhaust valves of the power source 12 to a relatively greater extent than at the low setting. As a result, during each compression stroke, relatively more highly-compressed air will be vented to the atmosphere at the medium setting than at the low setting. Alternatively, at such a medium setting, the engine retarder 30 may operate the valve disposed within the exhaust manifold of the power source 12 to controllably restrict the exiting flow of exhaust gases to a relatively greater extent than at the low setting. Such an increased flow restriction may cause a correspondingly increased backup of pressure within the power source 12 at the medium setting.

Operation of the engine retarder 30 may continue at the substantially constant medium setting until the brake pressure reaches a third brake pressure threshold. Such a third brake pressure threshold may be between approximately 10 bar and approximately 12 bar, and upon reaching this third brake pressure threshold, the controller 32 may output a third discrete command (shown as "3" on the Y axis of the graph in FIG. 3) to the engine retarder 30, controlling the engine retarder 30 to operate at a substantially constant high or "maximum" setting. At such a maximum setting, the engine retarder 30 may, for example, fully open the combustion chamber exhaust valves of the power source 12. As a result, during each compression stroke, relatively more highly-compressed air will be vented to the atmosphere at the maximum setting than at the medium setting, and fully-opening the exhaust valves in this way may maximize the retarding capabilities of the engine retarder 30. Alternatively, at such a maximum setting, the engine retarder 30 may operate the valve disposed within the exhaust manifold of the power source 12 to controllably restrict the exiting flow of exhaust gases to a relatively greater extent than at the medium setting. At the maximum setting, the valve may form the maximum flow restriction permitted during machine operation without stalling the power source 12. Such an increased flow restriction may cause a correspondingly increased backup of pressure within the power source 12.

In additional exemplary embodiments, activation and/or operation of the engine retarder 30 may be controlled incrementally based on brake pressure, and operation of the engine retarder 30 may be varied within such increments. For example, operation of the engine retarder 30 may be pulsed within such increments between two of the adjacent settings (off, low, medium, maximum) described above. Moreover, the width of each pulse may be varied during each operating increment based on, for example, brake pressure, time, and/or any other like variable or operating characteristic.

Three exemplary operating increments are illustrated in FIG. 5. An exemplary first operating increment begins at approximately time zero and extends to approximately time 100, a second increment begins at approximately time 100 and extends to approximately time 200, and a third increment begins at approximately time 200 and extends to approximately time 300. When operating in the first increment, the engine retarder 30 may alternate (i.e., pulse) between operating at idle and operating at the "low" setting corresponding to a first discrete engine retarder command (shown as "1" on the right hand side Y axis of the graph in FIG. 5). As illustrated by the second control line 60 shown in FIG. 5, operation of the engine retarder 30 may be varied approximately every 10 seconds (i.e., during each pulse) during the first increment. For example, each 10 second segment of the first operating increment of the engine retarder 30 may be characterized by a unique pulse percentage (illustrated as "Percent of Pulse" on the Y axis of FIG. 4). The engine retarder 30 may operate in the "off" or idle position for 100 percent of a first 10 second segment of the first operating increment. This first 10 second segment may begin at time zero shown in FIG. 5, and brake pressure illustrated by the first control line 58 may be approximately zero at time zero.

As shown by FIGS. 4 and 5, the engine retarder 30 may operate in the "off" position for 90 percent of a second 10 second segment of the first operating increment, and may operate at the low setting corresponding to the first engine retarder command (shown as "1" on the right hand side Y axis of FIG. 5) for 10 percent of the second 10 second segment. The engine retarder 30 may operate in the "off" position for 80 percent of a third 10 second segment of the first operating increment, and may operate at the low setting corresponding to the first engine retarder command for 20 percent of the third 10 second segment. Such varying pulsed control of the engine retarder 30 may continue during the first operating increment until, for example, a final 10 second segment of the first increment in which the engine retarder 30 may operate in the "off" position for zero percent of the final segment, and may operate at the low setting for 100 percent of the final segment. As shown by the first control line 58 of FIG. 5, the brake pressure may be equal to between approximately 2 bar and approximately 3 bar once the final 10 second segment of the first operating increment has been reached.

As shown in FIG. 5, a second operating increment of the engine retarder 30 may begin at approximately time 100. During this second operating increment, control of the engine retarder 30 may be substantially similar to that described above with respect to the first operating increment. During the second operating increment, however, operation of the engine retarder 30 may be pulsed between the low setting corresponding to the first engine retarder command and the medium setting corresponding to the second engine retarder command (shown as "2" on the right hand side Y axis of FIG. 5). Additionally, the pulse percentage (i.e., pulse width) may be varied in 10 second segments during the second operating increment as described above with respect to the first operating increment. For example, as shown in FIG. 5, beginning at approximately time 100, the engine retarder 30 may be controlled to operate at the low setting for 100 percent of a first 10 second segment of the second operating increment. As shown by FIGS. 4 and 5, the engine retarder 30 may operate at the low setting for 90 percent of a second 10 second segment of the second operating increment, and may operate at the medium setting corresponding to the second engine retarder command for 10 percent of the second 10 second segment.

Such varying pulsed control of the engine retarder 30 may continue during the second operating increment until, for example, a final 10 second segment of the second increment in which the engine retarder 30 may operate at the low setting for zero percent of the final segment, and may operate at the medium setting for 100 percent of the final segment. As shown by the first control line 58 of FIG. 5, the brake pressure may be equal to between approximately 4 bar and approximately 6 bar once the final 10 second segment of the second operating increment has been reached. It is understood that a similar engine retarder control strategy may be utilized during the third operating increment beginning at time 200. During the third operating increment, operation of the engine retarder 30 may be pulsed between the medium setting corresponding to the second engine retarder command and the maximum setting corresponding to the third engine retarder command (shown as "3" on the right hand side Y axis of FIG. 5). As shown by the first control line 58 of FIG. 5, the brake pressure may be equal to between approximately 7 bar and approximately 9 bar once the final 10 second segment of the third operating increment has been reached.

It is understood that during the pulsed operation described above with respect to FIGS. 4 and 5, the engine retarder 30 may repeatedly open and close the combustion chamber exhaust valves of the power source 12 near TDC of the compression stroke. Such repeated opening and closing may vent highly-compressed air to the atmosphere, in a pulsed manner at the various (zero, low, medium, and maximum) retarding levels described above with respect to FIG. 5, during each compression stroke. Alternatively, the engine retarder 30 may operate a valve disposed within an exhaust manifold of the power source 12 to repeatedly open and close, and such repeated opening and closing may pulsedly restrict the exiting flow of exhaust gases. The pulsed restriction of exhaust gases may cause a backup of pressure within the power source 12 at the various (zero, low, medium, and maximum) retarding levels described above with respect to FIG. 5.

In still further exemplary embodiments, activation and/or operation of the engine retarder 30 may be controlled substantially continuously based on brake pressure. For example, as described above with respect to the first control line 58 shown in FIG. 5, brake pressure may be increased substantially continuously during operation of the machine 10. Such an increase may be affected by, for example, the operator depressing the brake pedal 46*b* at a substantially continuous rate during a machine braking operation. As illustrated by the second control line 60 shown in FIG. 6, the engine retarder 30 may be activated in response to the application of brake pressure and/or substantially simultaneously with activation of the brake mechanism 20. It is understood that the first control line 58 has been omitted from FIG. 6 for clarity. Upon activation of the brake mechanism 20 and/or once generation of a first brake pressure commences, the controller 32 may output a continuous command (shown as a percentage of maximum engine retarder retarding capacity on the Y axis of the graph in FIG. 6) to the engine retarder 30. Such an output command may be generated by, for example, sensing the brake pressure associated with the brake mechanism 20, and inputting information indicative of the brake pressure into one or more algorithms, look-up tables, and/or control maps stored within a memory of the controller 32. Accordingly, the output command may be determined based on and/or as a function of the brake pressure. As represented by the second control line 60, such output commands may be determined as a percentage of the maximum engine retarder retarding capacity.

In each of the exemplary embodiments described herein, the controller 32 may increase the natural resistance of power source 12, if it is determined that the current amount of retarding (e.g., the current rate of deceleration) is insufficient. For example, the controller 32 may receive one or more inputs associated with the throttle pedal 46*a* and the brake pedal 46*b*, and in response, the controller 32 may determine whether or not additional deceleration is desired. Additional desired deceleration may be indicated by reducing an actuation position of the throttle pedal 46*a*, increasing the actuation position of the brake pedal 46*b*, and/or continued actuation of the brake pedal 46*b* for an extended period of time. Alternatively, the current deceleration rate of the machine 10 may be directly monitored via the power source speed sensor 34 or the machine travel speed sensor 40 and compared to a deceleration rate threshold value stored within the memory of the controller 32. The controller 32 may then activate the engine retarder 30 to increase the natural resistance of the power source 12, thereby increasing the retarding affect.

In addition, the controller 32 may initiate or increase parasitic loading of the power source 12 and/or machine 10 if the current level of retarding is insufficient. Parasitic loading of the power source 12 and/or the machine 10 may include, among other things, the activation of a cooling fan, an air conditioning pump, a hydraulic implement pump, an electric generator, and other such devices that draw power from the power source 12 and/or the machine 10.

The controller 32 may also be configured to initiate a downshift of the transmission 16 to increase the retarding effect of the engine retarder 30. In particular, the controller 32 may determine that the engine retarder 30 is active and may determine a current deceleration rate of the machine 10 resulting from the operation of the engine retarder 30. If the current deceleration rate of the machine 10 is less than desired or less than the predetermined deceleration threshold value, the controller 32 may actuate one or more clutches associated with the transmission 16 to selectively engage a predetermined combination of gears, thereby effecting the desired downshift. It is also understood that the lockup clutch 22 of the torque converter 14 may be engaged in such embodiments to increase the machine and/or power source retarding.

Figure 7:
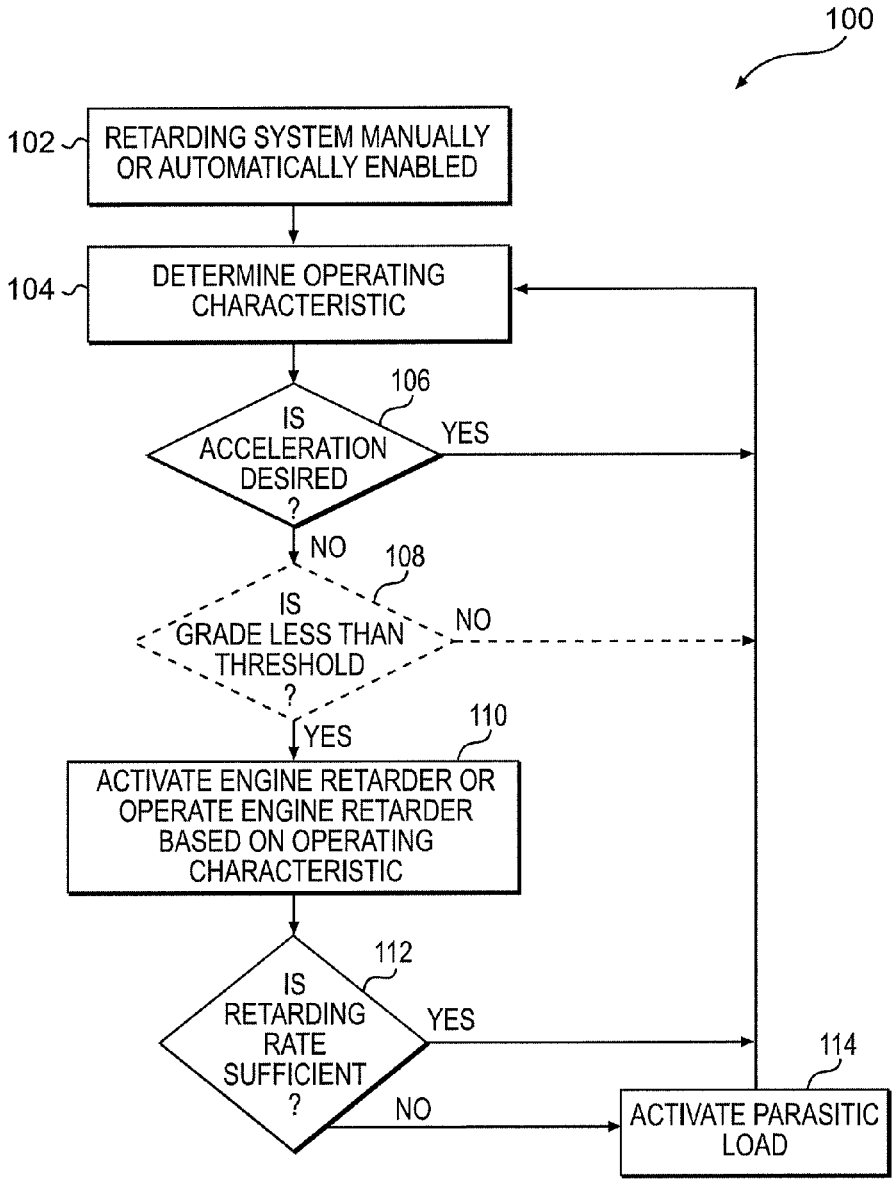
FIG. 7 is a flow chart depicting an exemplary method of operating the retarding system of FIG. 2.

The flow chart 100 shown in FIG. 7 illustrates an exemplary method of operating the retarding system 28. FIG. 7 will be described in detail below.

INDUSTRIAL APPLICABILITY

The disclosed retarding system may be applicable to any machine where retarding is desired, and may be useful during operations in which extended machine braking is required. The disclosed retarding system 28 may activate the engine retarder 30, substantially simultaneously with the brake mechanism 20, in response to brake pressure. Additionally, upon activation, operation of the engine retarder 30 may be controlled as a function of the brake pressure associated with the brake mechanism 20. Activation of the engine retarder 30 in this way may provide an operator of the machine 10 with increased control over the engine retarder 30 as compared to known control methods. Additionally, operating the engine retarder 30 as a function of brake pressure may improve the retarding capabilities of the machine 10 over known methods, and may reduce wear on the brake mechanism 20 during extended machine braking.

As shown in FIG. 7, the operation of the retarding system 28 may be initiated in various different ways. For example, at Step: 102, an operator may manually enable the retarding system 28 via any of the operator interface devices 46 described herein. In exemplary embodiments, a dedicated retarding system enable switch or other like operator interface device 46 may be located in the operator station 21 for use in manually enabling the retarding system 28. As shown at Step: 102, in additional exemplary embodiments, the retarding system 28 may be configured for automatic enablement during a manufacturing process or, alternatively, by a service technician according to customer preference upon purchase or leasing of the machine 10.

After the retarding system 28 has been enabled at Step: 102, the controller 32 may determine one or more operating characteristics of the machine 10 at Step: 104. Such operating characteristics may comprise any of the parameters described above with respect to the one or more sensors of the machine 10. Such operating characteristics may include, for example, brake pressure, the grade on which the machine 10 is located, power source speed, machine travel speed, throttle pedal position, brake pedal position, and/or other like operating characteristics. Such operating characteristics may also include any known parameters that may be calculated, generated, and/or otherwise determined based on one or more of for example, brake pressure, the grade on which the machine 10 is located, power source speed, machine travel speed, throttle pedal position, brake pedal position. For example, such operating characteristics may also include power source output torque, transmission output torque, retarding torque, and/or any of the discrete or continuous engine retarder commands described herein. At Step: 104, the operating characteristics may be determined by the sensors described herein or by the controller 32 using one or more algorithms, look-up tables, data maps, graphs, and/or other like means. In such exemplary embodiments, the controller 32 may determine the operating characteristics described herein using signals and/or information received from such sensors as inputs to the one or more algorithms, look-up tables, data maps, graphs, and/or other like means.

Control may proceed to Step: 106 where the controller 32 may determine whether or not acceleration of the machine 10 is desired. In exemplary embodiments, signals generated by the throttle pedal 46*a* and/or the brake pedal 46*b* may provide an indication of operator-desired acceleration. For example, if the throttle pedal 46*a* is situated in a depressed position and then released, it can be assumed that a negative acceleration (e.g., deceleration) of the machine 10 is desired (Step: 106—No). The rate of releasing may provide an indication of the magnitude of the desired deceleration. In contrast, if the throttle pedal 46*a* is depressed to a greater extent, it can be assumed that a positive acceleration of the machine 10 is desired (Step: 106—Yes). Similarly, if the brake pedal 46*b* is depressed, it can be assumed that a negative acceleration of machine 10 is desired (Step: 106—No). The rate of depressing may provide an indication of the magnitude of the desired deceleration. In contrast, if brake pedal 46*b* is released from a depressed position, it can be assumed that the amount of deceleration is sufficient or that deceleration is no longer desired (Step: 106—Yes). In such embodiments, signals generated by the throttle sensor 47 and/or the brake sensor 51 may provide such an indication of operator-desired acceleration.

If positive acceleration is not desired (Step: 106—No), the controller 32 may determine whether the machine 10 is operating and/or located on a surface having an acceptable grade (Step: 108). For example, at Step: 108 the controller 32 may communicate with the inclinometer 49 to determine if machine 10 is operating on a decline. Control may continue to Step: 110 if the machine 10 is operating on a decline having a grade that is less than (i.e., steeper than) a grade threshold (Step: 108—Yes). In exemplary embodiments, such a steep grade may require activation and/or operation of the engine retarder 30 to maintain safe operation of the machine 10. Alternatively, control may return to Step: 104 if the machine 10 is operating on a grade greater than or equal to the threshold (Step: 108—No). For example, control may return to Step: 104 if the machine 10 is operating on a substantially level surface or on an incline. In this manner, the engine retarder 30 may only be activated in situations in which machine 10 is at risk of involuntarily accelerating down a declined grade. In still further exemplary embodiments, Step: 108 may be omitted and control may proceed directly from Step: 106 to Step: 110 upon determining that acceleration of the machine 10 is not desired (Step: 106—No).

At Step: 110, the controller 32 may activate the engine retarder 30 if the engine retarder 30 is not active, or may continue operation of the engine retarder 30 based on the operating characteristic determined at Step: 104. For example, at Step: 110 the engine retarder 30 may be activated substantially simultaneously with the brake mechanism 20, and such activation may be affected by the controller 32 in response to determining acceleration is not required (Step: 106—No). While the engine retarder 30 is active, operation of the engine retarder 30 may be controlled based on and/or as a function of, for example, brake pressure determined at Step: 104.

In exemplary embodiments, operation of the engine retarder 30 at Step: 110 may be controlled according to one of the graphs illustrated in FIGS. 3-6. For example, as illustrated by the second control line 60 shown in FIG. 3, the engine retarder 30 may be controlled in discrete (i.e., stepwise) increments in response to brake pressure. In such an exemplary embodiment, the engine retarder 30 may provide substantially continuous power source retarding, at discrete retarding levels, based on such brake pressure. As illustrated by the second control line 60 shown in FIG. 5, in another exemplary embodiment, the engine retarder 30 may be controlled in discrete (i.e., stepwise) increments in response to brake pressure, and operation of the engine retarder 30 may be variable (i.e., pulsed) within such increments. In such an exemplary embodiment, the engine retarder 30 may provide variable power source retarding, at discrete retarding levels, based on such brake pressure. As illustrated by the second control line 60 shown in FIG. 6, in still another exemplary embodiment, the engine retarder 30 may be controlled in a substantially continuous manner in response to brake pressure. In such an exemplary embodiment, the engine retarder 30 may provide substantially continuous power source retarding based on such brake pressure, and the engine retarder 30 may be controlled as a percentage of the maximum power source retarding capable of being provided by the engine retarder 30.

At Step: 112, the controller 32 may determine if the current rate of power source retarding is sufficient. The controller 32 may affect the rate of retarding in response to the determination. In exemplary embodiments, the controller 32 may determine if the current rate of retarding is sufficient by monitoring the actuation of throttle and brake pedals 46*a* and 46*b* or, alternatively, by comparing the rate of deceleration to a predetermined deceleration threshold value. If the rate of retarding is sufficient (Step: 112—Yes), control may return to Step: 104, and operation of the retarding system 28 may continue in a closed-loop manner until machine operation and/or machine braking is no longer required. Alternatively, if the controller 32 determines that the rate of retarding after substantially simultaneous activation and/or operation of the engine retarder 30 and the brake mechanism 20 is insufficient (Step: 112—No), the controller 32 may activate one or more parasitic loads (Step: 114) to increase the resistance of the power source 12. Activation of such parasitic loads at Step: 114 may include, among other things, activating and/or operating a cooling fan, an air conditioning system, an electric generator, a hydraulic implement pump, and/or any other component of the machine 10 that draws power from the power source 12. It is contemplated that if the rate of deceleration is still insufficient after the activation of such parasitic loads, the controller 32 may automatically trigger the transmission 16 to initiate a downshift, thereby transferring a greater amount of power to the power source 12 for dissipation. Upon activating one or more parasitic loads at Step: 114, control may return to Step: 104, and operation of the retarding system 28 may continue in a closed-loop manner until machine operation and/or machine braking is no longer required.

Several advantages of the retarding system 28 may be realized over the prior art. In particular, because the controller 32 activates the engine retarder 30 substantially simultaneously with the brake mechanism 20, at nearly any travel speed of machine 10, the retarding system 28 may provide a broader range of retarding than known systems activating the engine retarder at, for example, only high or low travel speeds. In addition, because the controller 32 activates the engine retarder 30 substantially simultaneously with the brake mechanism 20, in response to brake pressure, the engine retarder 30 of the present disclosure may be activated in certain situations (such as, for example, during a panic stop or other like emergency braking situations) where other manual or automatic activation methods may not trigger such activation. Moreover, because the controller 32 operates the engine retarder 30 substantially simultaneously with the brake mechanism 20, in response to brake pressure, wear on, for example, components of the brake mechanism 20 may be reduced, particularly during extended machine braking.

It will be apparent to those skilled in the art that various modifications and variations can be made to the retarding system 28 of the present disclosure. Other embodiments of the retarding system 28 will be apparent to those skilled in the art from consideration of the specification and practice of the retarding system 28 disclosed herein. It is intended that the specification and examples be considered as exemplary only, with a true scope of the disclosure being indicated by the following claims and their equivalents.

What is claimed is:

1. A machine, comprising:

a power source;

an engine retarder associated with the power source;

a traction device receiving power from the power source and configured to propel the machine;

a brake mechanism associated with the traction device;

an inclinometer configured to generate a signal indicative of a grade on which the machine is located; and a controller in communication with the engine retarder, the brake mechanism, and the inclinometer, the controller configured to receive the signal from the inclinometer and activate the engine retarder, during activation of the brake mechanism, based on a brake pressure associated with the brake mechanism only when the controller determines that the grade is less than a grade threshold, wherein controlling operation of the engine retarder includes:

operating the engine retarder, in a pulsed manner, within a plurality of operating increments, each increment of the plurality of operating increments lasting a first duration and including a plurality of discrete segments each lasting a second duration; and varying operation of the engine retarder within each segment of the plurality of segments, wherein the plurality of segments each last for a percentage of the corresponding increment, and wherein varying operation of the engine retarder within at least one segment of the plurality of segments includes operating the engine retarder at a first level for a first percentage of the at least one segment and operating the engine retarder at a second level for a second percentage of the at least one segment.

2. The machine of claim 1, wherein the machine includes a brake pedal and a brake sensor associated with the brake pedal, the brake sensor configured to provide a signal to the controller indicative of the brake pressure.

3. The machine of claim 1, wherein the controller is configured to operate the engine retarder at a substantially constant first retarding level when the brake pressure is less than a first threshold, and to operate the engine retarder at a substantially constant second retarding level greater than the first retarding level when the brake pressure is between the first threshold and a second threshold greater than the first threshold.

4. The machine of claim 1, wherein the controller is configured to operate the engine retarder, in a substantially constant manner, as a percentage of a maximum retarding capacity of the engine retarder, and wherein such operation of the engine retarder is controlled in a closed-loop manner as a function of the brake pressure.

5. The machine of claim 1, wherein the controller is configured to determine a rate of power source retarding after activating the engine retarder and the brake mechanism, and to activate a parasitic load receiving power from the power source in response to determining that the rate of power source retarding is insufficient.

6. The machine of claim 5, wherein the parasitic load comprises one of a cooling fan, an air conditioning pump, a hydraulic implement pump, and an electric generator.

7. The machine of claim 1, wherein the engine retarder comprises an engine brake configured to selectively open a valve associated with a combustion chamber of the power source, the engine brake being operable to release compressed air from the combustion chamber in response to the brake pressure.

8. The machine of claim 1, wherein the engine retarder comprises an exhaust brake configured to selectively close a valve fluidly connected to an exhaust manifold of the power source, the exhaust brake being operable to increase pressure in the exhaust manifold in response to the brake pressure.

9. A method of braking a machine, comprising:

determining an operating characteristic of the machine;

determining machine acceleration is not desired by an operator of the machine based on the operating characteristic;

activating an engine retarder of the machine, during activation of a brake mechanism of the machine, based on a first brake pressure associated with the brake mechanism; and controlling operation of the engine retarder based on the first brake pressure, wherein controlling operation of the engine retarder includes:

operating the engine retarder, in a pulsed manner, within a plurality of operating increments, each increment of the plurality of operating increments lasting a first duration and including a plurality of discrete segments each lasting a second duration; and varying operation of the engine retarder within each segment of the plurality of segments, wherein the plurality of segments each last for a percentage of the corresponding increment, and wherein varying operation of the engine retarder within at least one segment of the plurality of segments includes operating the engine retarder at a first level for a first percentage of the at least one segment and operating the engine retarder at a second level for a second percentage of the at least one segment.

10. The method of claim 9, wherein the operating characteristic comprises the brake pressure, the method further including determining a second brake pressure in a closed-loop manner, and controlling operation of the engine retarder based on the second brake pressure.

11. The method of claim 9, wherein controlling operation of the engine retarder comprises operating the engine retarder at a substantially constant first retarding level when the first brake pressure is less than a first threshold, and operating the engine retarder at a substantially constant second retarding level greater than the first retarding level upon determining a second brake pressure is between the first threshold and a second threshold greater than the first threshold.

12. The method of claim 11, further including maintaining operation of the engine retarder at the substantially constant first retarding level while the brake pressure associated with the brake mechanism increases from the first brake pressure to the second brake pressure.

13. The method of claim 9, wherein controlling operation of the engine retarder comprises operating the engine retarder, in a substantially constant manner, as a percentage of a maximum retarding capacity of the engine retarder.

14. A method of braking a machine having a power source, a brake mechanism, and an engine retarder, the method comprising:

determining a brake pressure associated with the brake mechanism, the brake mechanism comprising a service brake operable to retard motion of the machine;

determining a grade on which the machine is located;

directing a first signal indicative of the brake pressure and a second signal indicative of the grade to a controller of the machine in communication with the brake mechanism and the engine retarder;

activating the engine retarder with the controller, during activation of the brake mechanism, in response to determining the brake pressure only when the controller determines that the grade is less than a grade threshold; and controlling operation of the engine retarder with the controller in a closed-loop manner, wherein operation of the engine retarder comprises controlling a valve, operable to increase a natural resistance of the power source, based on the brake pressure, wherein controlling operation of the engine retarder includes:

operating the engine retarder, in a pulsed manner, within a plurality of operating increments, each increment of the plurality of operating increments lasting a first duration and including a plurality of discrete segments each lasting a second duration; and varying operation of the engine retarder within each segment of the plurality of segments, wherein the plurality of segments each last for a percentage of the corresponding increment, and wherein varying operation of the engine retarder within at least one segment of the plurality of segments includes operating the engine retarder at a first level for a first percentage of the at least one segment and operating the engine retarder at a second level for a second percentage of the at least one segment.

15. The method of claim 14, wherein the valve is fluidly connected to a combustion chamber of the power source, the valve being operable to release compressed air from the combustion chamber in response to the brake pressure.

16. The method of claim 14, wherein the valve is fluidly connected to an exhaust manifold of the power source, the valve being operable to increase pressure in the exhaust manifold in response to the brake pressure.

17. The method of claim 9, wherein varying operation of the engine retarder within at least one segment of the plurality of segments further includes operating, during a subsequent segment of the plurality of segments, the engine retarder at the first level for a new first percentage of the subsequent segment and operating the engine retarder at the second level for a new second percentage of the subsequent segment, wherein the new first percentage is less than the first percentage and the new second percentage is greater than the second percentage.

* * * * *

UNITED STATES PATENT AND TRADEMARK OFFICE

CERTIFICATE OF CORRECTION

PATENT NO. : 8,950,378 B2
APPLICATION NO. : 13/469678
DATED : February 10, 2015
INVENTOR(S) : Holt et al.

It is certified that error appears in the above-identified patent and that said Letters Patent is hereby corrected as shown below:

On the title page

Column 1, Item 73 (Assignee), line 1, delete "Caterpiller Inc.," and insert -- Caterpillar Inc., --.

Column 2, Item 74 (Attorney, Agent or Firm), line 1, delete "Finnegan." and insert -- Finnegan, --.

Signed and Sealed this
Twenty-third Day of February, 2016

Michelle K. Lee

Michelle K. Lee
*Director of the United States Patent and Trademark Office*